US006336009B1

(12) United States Patent
Suzumi et al.

(10) Patent No.: US 6,336,009 B1
(45) **Date of Patent: *Jan. 1, 2002**

(54) IMAGE HEATING APPARATUS AND HEATER FOR HEATING IMAGE

(75) Inventors: Masahiko Suzumi; Toshio Miyamoto; Kenji Kanari, all of Numazu (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/450,751

(22) Filed: Nov. 30, 1999

(30) Foreign Application Priority Data

Nov. 30, 1998 (JP) ..... 10-355413

(51) Int. Cl.[7] ..... G03G 15/20
(52) U.S. Cl. ..... 399/67
(58) Field of Search ..... 399/328–331, 399/67; 219/216, 469–471; 432/60

(56) References Cited

U.S. PATENT DOCUMENTS

| | | | | | |
|---|---|---|---|---|---|
| 4,585,325 | A | * | 4/1986 | Euler | 219/216 X |
| 4,825,242 | A | * | 4/1989 | Elter | 219/216 X |
| 5,041,718 | A | * | 8/1991 | d'Hondt et al. | 219/255 |
| 5,253,024 | A | | 10/1993 | Okuda et al. | 355/282 |
| 5,293,202 | A | | 3/1994 | Adachi et al. | 355/282 |
| 5,497,218 | A | * | 3/1996 | Amico | |
| 5,700,994 | A | * | 12/1997 | Gheer et al. | 219/497 |
| 5,722,026 | A | | 2/1998 | Goto et al. | 399/333 |
| 5,860,051 | A | | 1/1999 | Goto et al. | 399/529 |
| 5,862,435 | A | | 1/1999 | Suzumi et al. | 399/68 |
| 5,920,757 | A | | 7/1999 | Izawa et al. | 399/329 |
| 5,966,577 | A | * | 10/1999 | Abe | 399/320 |
| 5,994,671 | A | * | 11/1999 | Suzuki et al. | 219/216 |
| 6,011,939 | A | * | 1/2000 | Martin | 399/69 |
| 6,040,558 | A | * | 3/2000 | Yamazaki | 219/216 |

FOREIGN PATENT DOCUMENTS

| | | |
|---|---|---|
| JP | 63-313182 | 12/1988 |
| JP | 02-157878 | 6/1990 |
| JP | 04-044075 | 2/1992 |
| JP | 04-044076 | 2/1992 |
| JP | 04-044077 | 2/1992 |
| JP | 04-044078 | 2/1992 |
| JP | 04-044079 | 2/1992 |
| JP | 04-044080 | 2/1992 |
| JP | 04-044081 | 2/1992 |
| JP | 04-044082 | 2/1992 |
| JP | 04-044083 | 2/1992 |
| JP | 04-204980 | 7/1992 |
| JP | 04-204984 | 7/1992 |

* cited by examiner

*Primary Examiner*—Susan S. Y. Lee
(74) *Attorney, Agent, or Firm*—Fitzpatrick, Cella, Harper & Scinto

(57) ABSTRACT

The present invention relates to an image heating apparatus in which a heater being controlled by an output from a temperature detecting element to obtain a predetermined temperature and an image on a recording material being heated by heat from the heater via a film, the heater having a first heating member disposed along a longitudinal direction of a base material and heated by energizing and a second heating member shorter than the first heating member, the first heating member being disposed on an upstream side of the second heating member with respect to a moving direction of the recording material, and when a first size recording material is heated, the first heating member being energized and the second heating member being not energized, when a second size recording material smaller than the first size recording material is heated, the first heating member and the second heating member being energized.

31 Claims, 11 Drawing Sheets

EXAMPLE HEATING MEMBER LIGHTING DUTY H1:H2=a:b

| | SHEET NON-PASSING AREA | : SHEET PASSING AREA |
|---|---|---|
| HEATING MEMBER H1 | 3.36W/mm×a/(a+b) | : 3.36W/mm×a/(a+b) |
| HEATING MEMBER H2 | —— | : 6.43W/mm×b/(a+b) |
| TOTAL | 3.36W/mm×a | : 3.36W/mm×a + 6.43W/mm×b |

FRONT SURFACE SIDE OF HEATING MEMBER

REAR SURFACE SIDE OF HEATING MEMBER

IMAGE HEATING APPARATUS AND HEATER FOR HEATING IMAGE

BACKGROUND OF THE INVENTION

1. Field of the Invention

The present invention relates to an image heating apparatus of a film heating system applied to image forming apparatuses such as a copying machine and a printer, particularly to a heater applied to an image heating apparatus.

2. Related Background Art

In conventional image forming apparatuses such as a printer, a copying machine and a facsimile apparatus, as a fixing apparatus (fixing device) for heating/fixing an unfixed image (toner image) formed and borne on a recording material (transfer material, photosensitive paper, electrostatic recording paper, printing sheet, and the like) by appropriate image forming means such as an electrophotographic system and an electrostatic recording system in a transfer (indirect) system or a direct system, an apparatus of a heat roller system is widely used.

The apparatus of the heat roller system has a fixing roller (thermal roller, heat roller) as a fixing member and a pressure roller as a pressurizing member which are pressed to contact each other and rotate. When a recording material with an unfixed image formed and borne thereon is introduced, nipped, conveyed, and passed via a fixing nip portion (heating nip portion) as a pressed portion of both rollers, the unfixed image can be heated/fixed as a permanent fixed image on a recording material surface by the heat of the fixing roller and the pressurizing force of the fixing nip portion.

In recent years, from the standpoint of promotion of energy saving, an apparatus of a film heating system has been placed for practical use as an on-demand image heating apparatus high in thermal conduction efficiency and fast in starting the apparatus.

As proposed in Japanese Patent Application Laid-Open Nos. 63-313182, 2-157878, 4-44075 to 4-44083, and 4-204980 to 4-204984, this has a fixed/supported heating member, a heat resistant film which slides on the heating member, and a pressurizing member contacting the heating member via this film to form a fixing nip portion. The heating member is heated/adjusted to a predetermined temperature, and a recording material with an unfixed image formed/borne thereon is introduced between the film and the pressurizing member at the fixing nip portion, and nipped/conveyed with the film through the fixing nip portion, so that the unfixed image is heated/fixed as a permanent fixed image on a recording material surface by the heat from the heating member via the film and the pressurizing force of the fixing nip portion.

In the image heating apparatus of the film heating system, a linear heating member with a low thermal capacity such as a so-called ceramic heater as the heating member, and a thin heat resistant film with a low thermal capacity as the heat transfer member can be used. The temperature of the heating member is raised in a short time, and the rising of the temperature of the heating member or the fixing nip portion to a predetermined temperature can quickly be performed. No power is supplied to the apparatus (heating member) during standby, and the power consumption can be minimized. Therefore, as compared with the other image heating apparatus of the heat roller system or the like, power can be saved and wait time can be shortened (quick start property), so that the on-demand image heating apparatus can be constituted.

FIG. 10 is a schematic view showing a main part of one example of the image heating apparatus (heating/fixing apparatus) of the film heating system.

Specifically, the image heating apparatus has a heating member 11 (hereinafter referred to as the heater) fixed/supported on a stay holder (heater supporter) 12, and an elastic pressure roller 20 held and pressed onto the heater 11 via a heat-resistant thin film 13 (hereinafter referred to as the fixing film) to form a fixing nip portion N with a predetermined nip width.

When electricity is supplied, the heater 11 is heated to a predetermined temperature, and the temperature is adjusted.

The fixing film 13 is a cylindrical member, an endless belt-like member, or a rolled web-like member having ends. The film is attached and slid onto the surface of the heater 11 in the fixing nip portion N, and conveyed/moved in a direction of arrow a.

When the heater 11 is heated to the predetermined temperature, the temperature is controlled, and the fixing film 13 is conveyed/moved in the direction of arrow a, a recording material P with an unfixed toner image t formed/borne thereon is introduced as a material to be heated between the fixing film 13 and the pressurizing roller 20 of the fixing nip portion N. Then, the recording material P is attached to the surface of the fixing film 13, and held/conveyed with the fixing film 13 through the fixing nip portion N.

In the fixing nip portion N, the recording material P with the toner images t is heated by the heater 11 via the fixing film 13 so that the toner images t on the recording material P are heated/fixed.

The recording material portion passed through the fixing nip portion N is peeled off from the surface of the fixing film 13 and conveyed.

A ceramic heater is usually used in the heater 11. FIG. 11A is a partially cut plan model view showing the front surface side (heating surface side) of the ceramic heater 11, and FIG. 11B is a plan model view of the rear surface side (surface side opposite to the heating surface).

Specifically, for example, the front surface side (surface on the side facing the fixing film 13) of a ceramic substrate 11*a* of alumina having electric insulation properties, good thermal conductivity, and a low thermal capacity is provided with a energizing heating resistance layer (heating member) 11*b* of Ag/Pd (silver palladium), $Ta_2N$, and the like formed along the longitudinal direction of the substrate by screen printing or the like. Furthermore, the surface with the energizing heating resistance layer formed thereon is covered with a thin glass protective layer 11*c*. For the heater 11, by supplying power via a power supplying electrode portion 11*d*, the energizing heating resistance layer 11*b* is heated so that the temperature of the entire heater is rapidly raised.

The temperature rise of the heater 11 is detected by temperature detecting means 14 disposed on the heater rear surface, and fed back to a energizing controller (not shown) via electric path patterns 11*e*, through holes 11*f*, and electrode portions 11*g* for output to a temperature controller.

The energizing controller controls the energizing of the energizing heating resistance layers 11*b* so that the heater temperature detected by the temperature detecting means 14 is maintained at a substantially constant predetermined temperature (fixing temperature). Specifically, the heater 11 is heated and controlled or adjusted to the predetermined fixing temperature.

The fixing film 13 is formed to be remarkably thin as 20 to 70 $\mu$m in order to efficiently give the heat of the heater 11 to the recording material P as the material to be heated in the fixing nip portion N. This fixing film 13 is constituted of three layers, that is, a film base layer, a primer layer, and a mold release layer, the film base layer is on the side of the heater 11, and the mold release layer is on the side of the pressurizing roller 20. The film base layer is formed of polyimide, polyamide-imide, PEEK, or the like which is higher in insulation property than the glass protective layer 11*c* of the heater 11, and has a heat resistance and a high elasticity. Moreover, the mechanical strengths such as tear strength of the entire fixing film 13 are kept by the film base layer. The primer layer is formed of a thin layer which has a thickness of about 2 to 6 $\mu$m. The mold release layer is a toner offset preventive layer to the fixing film 13, and is formed by coating fluoroplastics such as PFA, PTFE and FEP in a thickness of about 10 $\mu$m.

Moreover, the stay holder 12 is formed, for example, of a heat-resistant plastic member to hold the heater 11, and also serve as a conveyance guide of the fixing film 13.

In the heating apparatus of the film heating system using such thin fixing film 13, the pressurizing roller 20 having an elastic layer is flatted along the lower flat surface of the heater 11 pressurized via the film 13 by a high rigidity of the ceramic heater 11 in the pressurizing portion to form the fixing nip portion N with the predetermined width, and only the fixing nip portion N is heated to realize a quick start heating/fixing.

Character S denotes a recording material conveying standard (sheet passing standard), and in the apparatus of the example, the standard is disposed in the middle of the recording material conveying area of an image forming apparatus main body in the longitudinal direction. The apparatus has a "central standard".

The width of the energizing heating resistance layer 11*b* of the heater 11 in the longitudinal direction, that is, an effective heat generating area W is formed to be slightly narrower as compared with a width D (pressurizing roller abutting area) of the elastic layer of the pressurizing roller 20 which abuts on the heater 11 via the fixing film 13. This prevents a problem that the temperature locally rises and breakage is caused by thermal stress when the energizing heating resistance layer 11*b* is protruded from the pressurizing roller 20.

Moreover, the effective heat generating area W of the energizing heating resistance layer 11*b* is formed in a sufficiently broader width than that of an area for conveying sheets with normal sizes such as A4 and LTR, that is, a passing portion A (normal sized sheet passing portion, large sized sheet passing portion). This can eliminate the influence of end portion temperature sag (by heat leakage to electric contacts, connectors 31, 32, and the like on the end portions of the heater 11), so that effective fixing properties can be obtained over the entire surface of the recording material P.

Furthermore, in some cases, the width of the energizing heating resistance layer 11*b* on the end portion of the sheet passing area is shortened, and the heating value of the end portion is increased to compensate for the fixing properties of the end portions.

Therefore, the heat generated by energizing the energizing heating resistance layer 11*b* of the heater 11 is given to the recording material P conveyed between the fixing film 13 and the pressurizing roller 20, and acts to melt and fix the toner images t on the recording material P.

The temperature detecting element 14 such as a thermistor, and a thermo-protector 15 such as a temperature fuse and a thermo-switch for shutting down the energizing of the energizing heating resistance layer 11*b* of the heater 11 during runaway abut on the rear surface of the heater 11. The temperature detecting element 14 and the thermo-protector 15 are disposed in an area for conveying small sized sheets such as envelopes, that is, a small sized sheet passing portion B (minimum width recording material conveying area). The thermo-protector 15 is interposed in series with the power supply path to the energizing heating resistance layer 11*b*.

Here, the temperature detecting element 14 is disposed in the small sized sheet passing portion B, so that even when the recording material P having the minimum width that can be conveyed in the image forming apparatus main body is conveyed, the toner image t on the recording material P is heated/fixed at an appropriate fixing temperature without causing any fixing failure, high temperature offset, or other problems.

On the other hand, the thermo-protector 15 is disposed in the small sized sheet passing portion B, so that when the recording material P with the minimum width is conveyed, in a non-conveying area, that is, a small sized sheet non-passing portion C which has a smaller heat resistance than the small sized sheet passing portion B as the conveying area, a problem that the thermo-protector 15 is incorrectly operated by overheating in the small sized sheet non-passing portion C to shut out the energizing even during normal conveyance, or other problems are prevented from occurring.

Additionally, since the thermo-protector 15 abuts on the rear surface of the heater 11, in some cases the heat amount generated in the energizing heating resistance layer 11*b* is taken by the thermo-protector 15, a sufficient heat amount cannot be applied to the recording material P, and fixing failure occurs in the abutting position of the thermo-protector 15. To prevent this, by slightly narrowing the energizing heating resistance layer 11*b* in the position corresponding to the abutting position of the thermo-protector 15 like 11*b*' and by setting the resistance value of the energizing heating resistance layer 11*b*' to be larger than the values of the other energizing heating resistance layer portions, the heat generating amount is secured. Thereby, the heat supply amount to the recording material P is set to be constant over the longitudinal direction of the heater 11, and excellent heating/fixing is realized without any fixing non-uniformity.

Since the temperature detecting element 14 also abuts on the rear surface of the heater 11 in the same manner as the thermo-protector 15, it is also feared that the heat generated by the energizing heating resistance layer 11*b* is taken by the temperature detecting element 14. However, by using the temperature detecting element 14 with a small heat capacity such as a chip thermistor, the heat amount taken from the heater 11 can be minimized. Therefore, even if the above-described countermeasure is not taken like in the thermo-protector 15, uniform fixing can be realized in the longitudinal direction of the heater without deteriorating the fixing uniformity of the recording material.

In the image heating apparatus of the film heating system as described above in the conventional example, when sheets (recording materials) different in size (sheet width) are passed, the heat amount taken from the heater differs in the sheet passing portion and the sheet non-passing portion. The temperature of the sheet non-passing portion in which heat is not taken by the sheet gradually rises as the sheets are passed (sheet non-passing portion temperature rise phenomenon), and finally exceeds the heat resistant temperatures of the heater, pressurizing roller, and heater holder. The problem is solved by enlarging the sheet passing interval.

However, in recent years, with the increase of adjustment temperature and input power for a higher speed printer, the temperature rise of the sheet non-passing portion has become more remarkable, which cannot be solved by the method of enlarging the sheet passing interval any more.

To solve this problem, zone heating is effective in which the heater is provided with a plurality of heating members (energizing heating resistance layers) different in heat generating area, and the heating/fixing is performed by changing the heating member to be heated in accordance with the sheet size.

FIGS. 12A, 12B and 12C are diagrams showing one example of the zone heating type heater 11 as the background art of the present invention. FIG. 12A is an enlarged transverse sectional model view of the heater 11, FIG. 12B is a plan model view of the rear surface side, and FIG. 12C is a pattern model view of a normal sized sheet heating member and a small sized sheet heating member.

The heater 11 in this example is a rear surface (back surface) heating type ceramic heater. Specifically, in the constitution, the substrate rear surface side (non-heating surface side) facing away from the front surface side (heating surface side, surface of the side facing the fixing film) of the highly heat conductive ceramic substrate 11*a* such as $Al_2O_3$ and AlN is provided with the heating member (energizing heating resistance layer such as Ag/Pb and $Ta_2N$).

In the heater 11 of this example, a normal sized sheet heating member H1, and a small sized sheet heating member H2 parallel with the member H1 are formed along the longitudinal direction on the rear surface side of the ceramic substrate 11*a*. Power supplying electrode portions 11*d*1, 11*d*1 are energized and formed on both end portions of the normal sized sheet heating member H1. Power supplying electrode portions 11*d*2, 11*d*2 are energized and formed on both end portions of the small sized sheet heating member H2. The thin glass protective layer 11*c* is formed to cover the surface on which the normal sized sheet and small sized sheet heating members are formed. The temperature detecting means (thermistor) 14 and the thermo-protector 15 are disposed to contact the surface of the glass protective layer 11*c* on the rear surface side of the heater.

Character S denotes a recording material conveying standard (sheet passing standard), and in the apparatus of the example, the standard is disposed in the middle of the recording material conveying area of the image forming apparatus main body in the longitudinal direction. The apparatus has a "central standard". Character X denotes a sheet passing direction.

The normal sized sheet heating member H1 is disposed for the recording materials of A4, LTR, LGL, and the like, its length L1 is set to 222 mm (equal to effective heat generating area W), and its width W1 is set to 3 mm.

The small sized recording material heating member H2 is adapted to the small sized sheet passing portion B for envelopes such as com 10, DL and monarch, its length L2 is set to 116 mm, and width W2 is set to 1.57 mm.

The temperature detecting element 14 and the thermo-protector 15 are disposed in the small sized sheet passing portion B.

When power is supplied between the power supplying electrode portions 11*d*1 and 11*d*1 during the passing of normal sized recording materials, the normal sized sheet heating member H1 is heated and the temperature of the entire heater is rapidly raised. This temperature rise of the heater 11 is detected by the temperature detecting element 14 and fed back to the energizing controller (not shown). The energizing controller controls the energizing of the normal sized sheet heating member H1 so that the heater temperature detected by the temperature detecting element 14 is maintained at a substantially constant predetermined temperature (fixing temperature).

When small sized recording materials are passed, power is supplied between the power supplying electrode portions 11*d*2 and 11*d*2, and the small sized sheet heating member H2 is heated. Subsequently, the temperature of the heater corresponding to the small sized sheet passing portion B is detected by the temperature detecting element 14 and fed back to the energizing controller. The energizing controller controls the energizing of the small sized sheet heating member H2 so that the heater temperature detected by the temperature detecting element 14 is maintained at the substantially constant predetermined temperature (fixing temperature).

However, when the zone heating is performed by independently energizing the heating members H1 and H2 different in heat generating area and by passing the sheets, temperature distributions h1 and h2 are formed in the sheet passing direction of the heater substrate as shown in FIG. 13. Specifically, when the heating member H1 positioned on the upstream side of the sheet passing direction is energized in the fixing nip portion N, the temperature distribution h1 is obtained in the sheet passing direction of the heater substrate, and the temperature in the fixing nip portion can be kept substantially uniformly. However, when the heating member H2 positioned on the downstream side is energized, the temperature distribution h2 is obtained in the sheet passing direction of the heater substrate, and a large temperature gradient is generated in the upstream/downstream direction in the fixing nip portion. This is because there is a large heat flux to the sheet from the heater on the upstream side on which sheet temperature is low, and there is a small heat flux on the downstream side on which the sheet temperature is high.

Therefore, when the temperatures of a plurality of heating members H1 and H2 are adjusted/controlled by one temperature detecting element (thermistor) 14, and when the heating members H1 and H2 are independently energized as described above, a moderate temperature gradient (usually the vicinity of temperature peak) differs with each case. Even when the temperature detecting element is placed substantially between the temperature peaks, a problem occurs that the detected temperature of the member H2 largely fluctuates within the attaching tolerance of the temperature detecting element.

Moreover, during the energizing of the heating member H2 positioned on the downstream side, since the entire heater substrate cannot be kept at a high temperature, there is a problem that the excellent fixing properties cannot be obtained.

SUMMARY OF THE INVENTION

An object of the present invention is to provide an image heating apparatus and an image heater in which heater temperature can correctly be detected even when there is an attaching position error of a temperature detecting element.

Another object of the present invention is to provide an image heating apparatus and an image heater in which a small sized recording material can sufficiently be heated.

Further object of the present invention is to provide an image heating apparatus comprising a heater having a long base material, a temperature detecting element for detecting temperature of the heater, and a film having one surface which slides on the heater and the other surface which moves while contacts a recording material bearing an image. The heater is controlled by an output from the temperature detecting element to obtain a predetermined temperature, the image on the recording material is heated by heat from the heater via the film, the heater has a first heating member disposed along a longitudinal direction of the base material and heated by energizing and a second heating member shorter than the first heating member, and the first heating member is disposed on the upstream side of the second heating member with respect to a moving direction of the recording material. When a first size recording material is heated, the first heating member is energized and the second heating member fails to be energized. When a second size recording material smaller than the first size recording material is heated, the first heating member and the second heating member are energized.

Another object of the present invention is to provide a heater for heating image comprising a long base material, a temperature detecting element for detecting temperature, a first heating member disposed along a longitudinal direction of the base material and heated by energizing, and a second heating member shorter than the first heating member. The first heating member and the second heating member are arranged in a direction orthogonal to the longitudinal direction of the base material, the first heating member is disposed for a first size recording material and a second size recording material smaller than the first size recording material, and the second heating member is disposed for the second size recording material.

Still another object of the present invention is to provide a heater for heating image comprising a long base material, a first heating member disposed along a longitudinal direction of the base material and heated by energizing, a second heating member shorter than the first heating member, and a third heating member having substantially the same length as the length of the first heating member. The first heating member, the second heating member and the third heating member are arranged in a direction orthogonal to the longitudinal direction of the base material, and the second heating member is disposed between the first heating member and the third heating member.

Further objects of the present invention would be apparent from the following description.

DETAILED DESCRIPTION OF THE PREFERRED EMBODIMENTS

Embodiments of the present invention will be described hereinafter with reference to the drawings.

<First Embodiment> (FIGS. 1 to 5)

(1) Image Forming Apparatus Example

Figure 1:
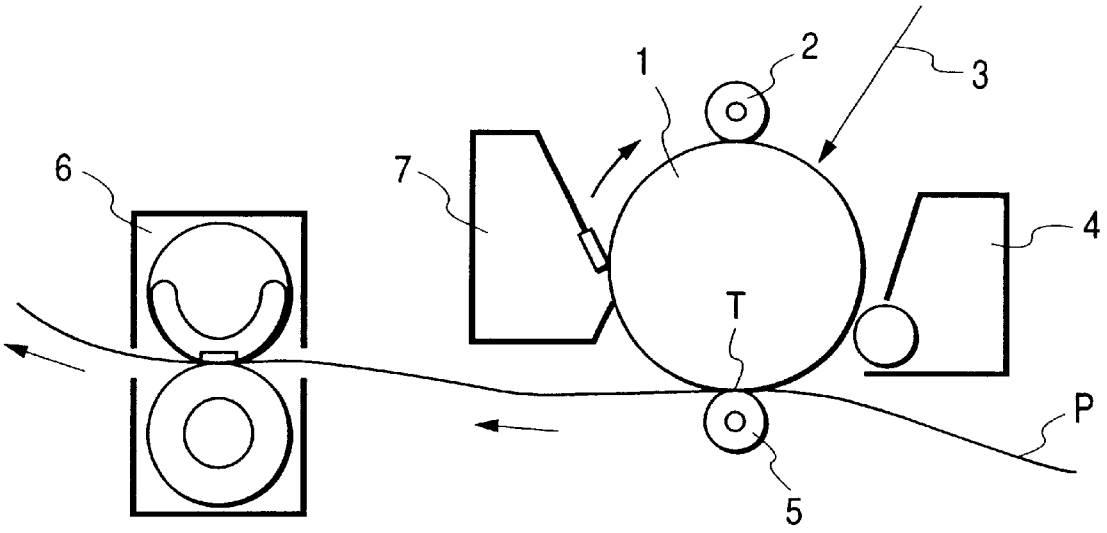
FIG. 1 is a diagrammatic view of an example of an image forming apparatus to which the present invention is applied.

FIG. 1 is a diagrammatic view showing the example of an image forming apparatus. The image forming apparatus of the example is a laser beam printer using a transfer type electrophotographic process.

Numeral 1 denotes a rotating drum type electrophotographic photosensitive unit as an image bearing unit (hereinafter referred to as the photosensitive drum). A photosensitive material layer such as OPC, amorphous Se and amorphous Si is formed on a cylindrical conductive substrate such as aluminum and nickel. The photosensitive drum 1 is rotated/driven with a predetermined peripheral speed (process speed) in a clockwise direction shown by an arrow.

First in the rotating process, the surface of the photosensitive drum 1 is uniformly charged to provide a predetermined polarity and potential by a charge roller 2 as a charge apparatus.

Subsequently, the surface is subjected to a laser beam scanning exposure 3 in accordance with a desired image information pattern by a laser scanner (not shown) as an exposure apparatus. Thereby, an electrostatic latent image is formed on the surface of the rotating photosensitive drum 1 in accordance with the desired image information pattern.

The laser scanner outputs a laser beam which is ON/OFF controlled in response to a time series electric digital pixel signal of the image information pattern transmitted from external apparatuses such as a host computer, and the surface of the photosensitive drum 1 to be uniformly charged/processed is scanned/exposed with this laser beam.

The electrostatic latent image formed on the surface of the photosensitive drum 1 is toner-developed and visualized by a developing apparatus 4. As the developing method, a jumping developing method, two-component developing method, FEED developing method, and the like are used, and in many cases a combination of image exposing and reverse developing is used.

The toner image formed on the surface of the rotating photosensitive drum 1 is successively transferred to the recording material (transfer material) P which is supplied to a transfer nip portion T from a sheet supply portion (not shown) in a predetermined control timing in the transfer nip portion T formed by the photosensitive drum 1 and a transfer roller 5 contacting the photosensitive drum 1 with a constant pressurizing force as a transfer apparatus.

A predetermined transfer bias is applied to the transfer roller 5 from a power supply (not shown) in a predetermined control timing, and the toner image on the surface of the photosensitive drum 1 is successively transferred to the surface of the recording material P nipped/conveyed through the transfer nip portion T by the action of the transfer bias.

The recording material P receiving the transferred toner image in the transfer nip portion T and passing through the transfer nip portion T is separated from the surface of the rotating photosensitive drum 1, and conveyed to a fixing apparatus 6 as an image heating apparatus, so that the toner image is fixed as a permanent image.

On the other hand, residual toner resulting from the transfer on the photosensitive drum 1 is removed from the surface of the photosensitive drum 1 by a cleaning device 7.

In the embodiment, the process speed of the image forming apparatus is 94 mm/s, and throughput is 16 ppm (A4).

(2) Fixing Apparatus 6

Figure 2:
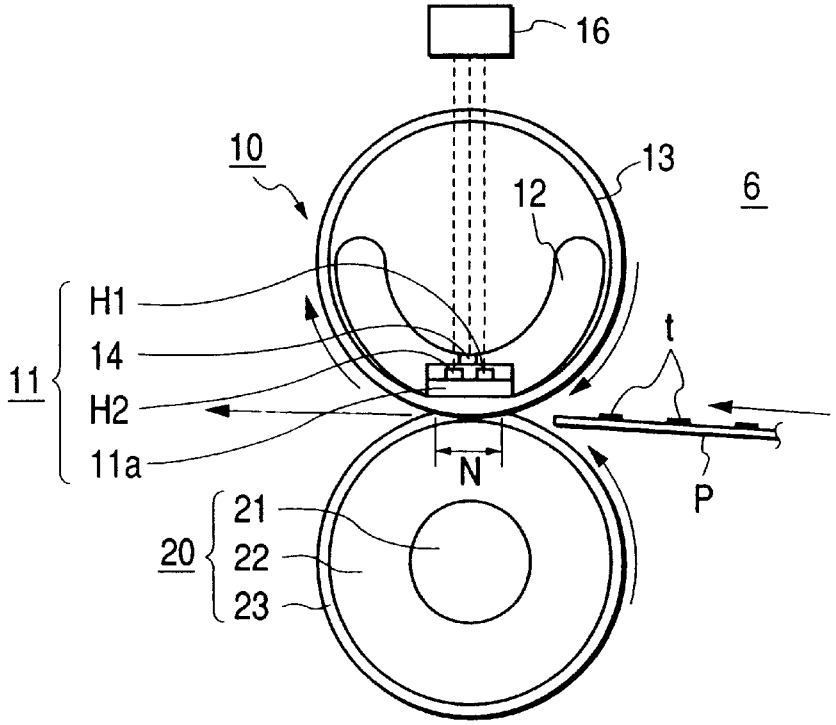
FIG. 2 is a transverse sectional model view of a fixing apparatus.

The fixing apparatus 6 as the image heating apparatus in the embodiment is a heating/fixing apparatus of a film heating system using a cylindrical fixing film, of a pressurizing roller drive type and of a tensionless type. FIG. 2 is a transverse sectional model view of the apparatus 6.

A fixing member 10 and a pressurizing member 20 abut on each other to form the fixing nip portion N.

The fixing member 10 is constituted of a heating member 11 (hereinafter referred to as the heater), an insulating stay holder 12, a fixing film 13, and the like. The pressurizing member 20 is an elastic pressurizing roller.

The heater 11 is a thin and horizontally long ceramic heater formed of a highly thermal conductive $Al_2O_3$ or AIN substrate and extended long in a vertical direction to a sheet surface. In the embodiment, the ceramic heater of a zone heating type and-of a rear surface heating type is used.

There are provided a substrate 11*a* as a base material, a normal sized sheet heating member H1 as a first heating member, a small sized sheet heating member H2 as a second heating member, a thermistor 14 as a temperature detecting element, and energizing control means 16. There is only one thermistor 14. The energizing control means 16 controls the energizing to the heating members H1, H2 based on an output from the thermistor 14 so that the heater 11 reaches a predetermined temperature.

The energizing control means 16 also controls the selection of the heating member to be energized from the heating members H1, H2 in accordance with the size of the recording material.

This heater 11 will be detailed in the next paragraph (3).

The insulating stay holder 12 is a member for holding the heater 11, and preventing heat radiation in the opposite direction to the fixing nip portion N, and is formed of liquid crystal polymer, phenol resin, PPS, PEEK, and the like. The insulating stay holder 12 of the embodiment has a transverse sectional form like a substantially semicircular arc trough, and is a horizontally long, heat resistant and electrically insulating member which can bear a heavy load. The heater 11 is engaged, fixed and supported in a groove portion disposed in the substantially central portion of the lower face of the insulating stay holder 12 along the longitudinal direction of the holder with its surface side facing or exposed downward.

The fixing film 13 is a cylindrical heat resistant film loosely attached to the insulating stay holder 12 including the heater 11 with an allowance placed along the peripheral length, and the insulating stay holder 12 supports the inner surface of the fixing film 13.

The fixing film 13 with a small heat capacity is formed in a total thickness of 100 $\mu$m or less to realize quick start, and is formed of a base layer of polyimide, polyamide-imide, PEEK, PES, PPS, PFA, PTFE, FEP, or the like, which has heat resistance and thermoplasticity. Moreover, the total thickness of 20 $\mu$m or more is necessary for the film which has a sufficient strength to constitute a long life heating/fixing apparatus and which is superior in durability. Therefore, the optimum total thickness of the fixing film 13 is in the range of 20 $\mu$m to 100 $\mu$m. Furthermore, to prevent the offset and secure the separating property of the recording material, the surface layer is mixed with or covered singly with a heat resistant resin which is excellent in mold release property, such as PFA, PTFE, FEP, and silicone resin.

The elastic pressurizing roller 20 as the pressurizing member is constituted of-a core metal 21, and an external elastic layer 22 formed by foaming heat resistant rubber, such as silicon rubber and fluororubber, or silicon rubber. Furthermore, a mold release layer 23 of PFA, PTFE, FEP or the like may be formed on the layer 22.

This elastic pressurizing roller 20 is held by a bearing member (not shown), pressed onto the downward facing surface of the heater 11 fixed/supported on the lower surface side of the insulating stay holder 12 via the fixing film 13, and sufficiently pressurized from both end portions of the longitudinal direction by pressurizing means (not shown) so as to form the fixing nip portion N necessary for the heating/fixing.

The pressurizing roller 20 is rotated/driven in a counterclockwise direction shown by an arrow by drive means (not shown). The pressurizing friction force generated between the outer surfaces of the roller 20 and the fixing film 13 in the fixing nip portion N by the rotation/drive of the pressurizing roller 20 exerts a rotating force to the fixing film 13, so that while the inner surface of the fixing film 13 is attached and slid onto the downward facing surface of the heater 11 in the fixing nip portion N, the fixing film 13 is driven to rotate along the outer periphery of the insulating stay holder 12 with a peripheral speed substantially corresponding to the rotating peripheral speed of the pressurizing roller 20 in the clockwise direction shown by an arrow.

In this case, for the cylindrical fixing film 13 driven/rotated along the outer periphery of the insulating stay holder 12, the fixing film portions other than the peripheral long fixing nip portion N and the fixing film portion in the vicinity of the portion N are in a tension free state (the state in which no tension is applied).

Since the inner surface of the fixing film 13 slidably contacts a part of each outer surface of the heater 11 and the insulating stay holder 12 and rotates, the friction resistance of the heater 11 and the insulating stay holder 12 with the fixing film 13 needs to be minimized. For this purpose, a small amount of lubricant such as heat resistant grease is applied to the surfaces of the heater 11 and the insulating stay holder 12. Thereby, the fixing film 13 can smoothly rotate.

As described above, the pressurizing roller 20 is rotated/driven, the cylindrical fixing film 13 is accordingly driven/rotated along the outer periphery of the insulating stay holder 12, the heater is energized to generate heat, and therefore the temperature of the fixing nip portion N rises to the predetermined temperature and is adjusted. In this state, the recording material P bearing a formed and unfixed toner image t is introduced to the fixing nip portion N, and the surface side bearing the unfixed toner image of the recording material P closely abuts on the outer surface of the fixing film 13 in the fixing nip portion N, and is nipped/conveyed together with the fixing film 13 through the fixing nip portion N.

In the nipping/conveying process of the recording material P, the heat of the heater 11 is transmitted to the recording material via the fixing film 13, and the unfixed toner image t on the recording material P is thermally pressurized and fixed, When the recording material P is passed through the fixing nip portion N, the material is separated from the outer surface of the fixing film 13 with a curvature and discharged onto a discharge tray (not shown).

(3) Heater 11 and Energizing Control

Figure 3A:
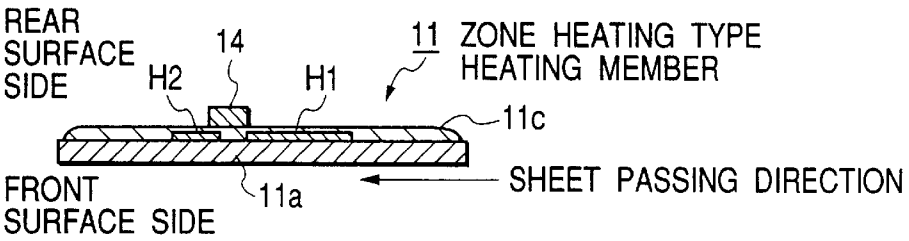
FIGS. 3A, 3B and 3C are explanatory views of a heating member.
Figure 3B:
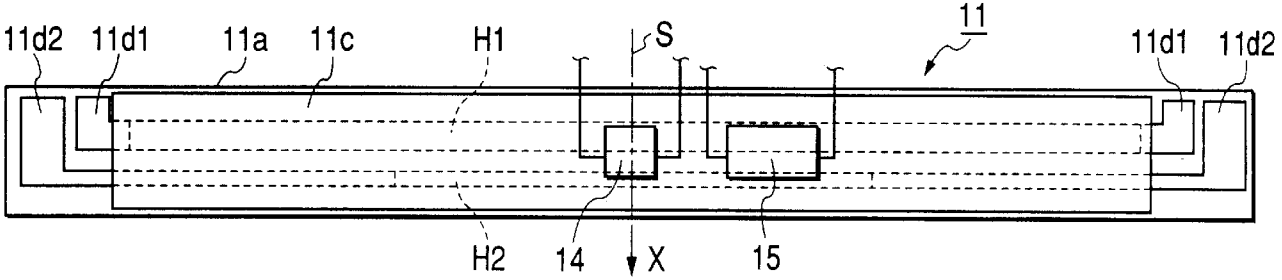
Figure 3C:
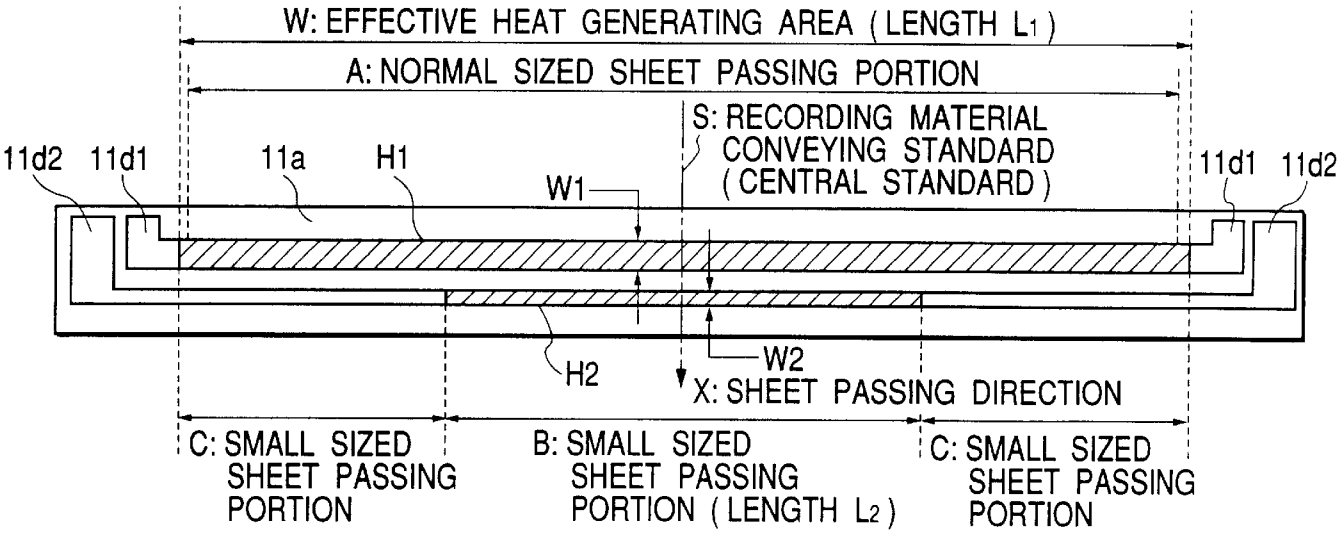

FIG. 3A is an enlarged transverse sectional view of the heater 11, FIG. 3B is a plan model view of the rear surface side, and FIG. 3C is a pattern model view of the normal sized sheet heating member and the small sized sheet heating member.

Figure 11A:
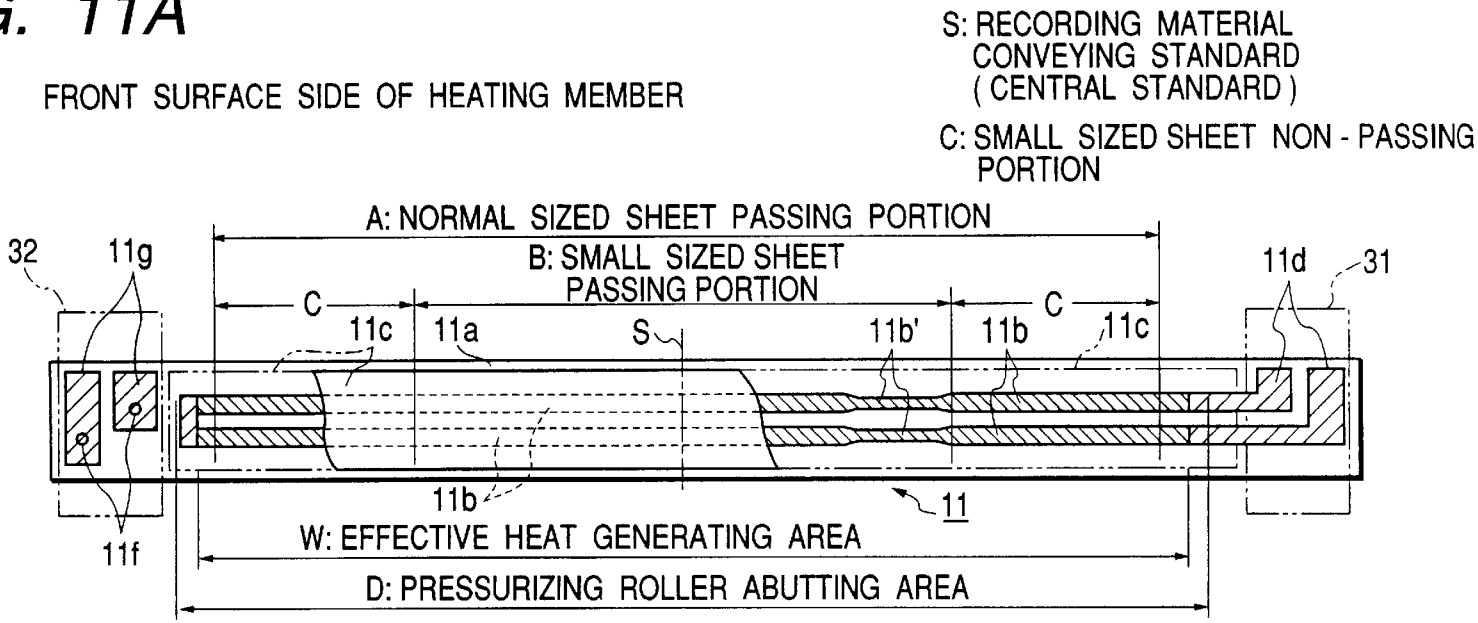
FIGS. 11A and 11B are explanatory views showing the constitution of the heating member (surface heating type).
Figure 11B:
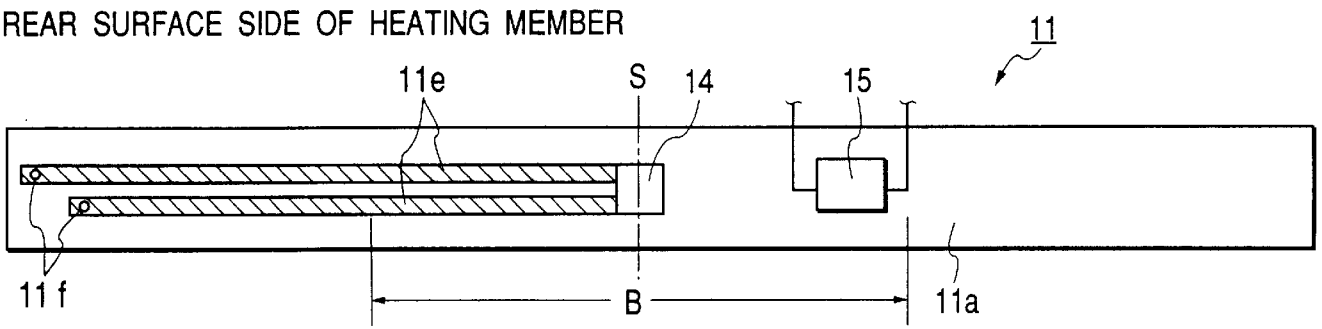
Figure 12A:
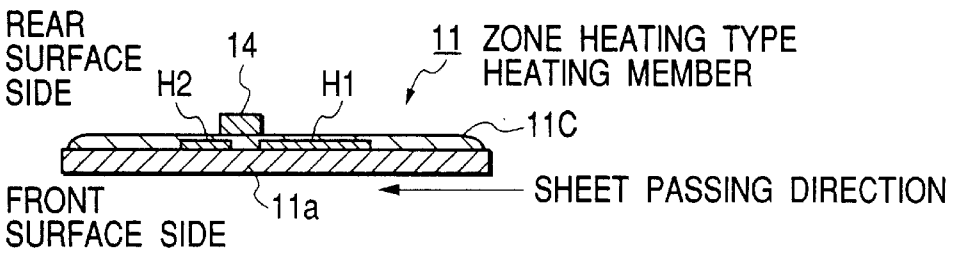
FIGS. 12A, 12B and 12C are explanatory views showing the constitution of a rear surface heating type heating member as the background art of the present invention.
Figure 12B:
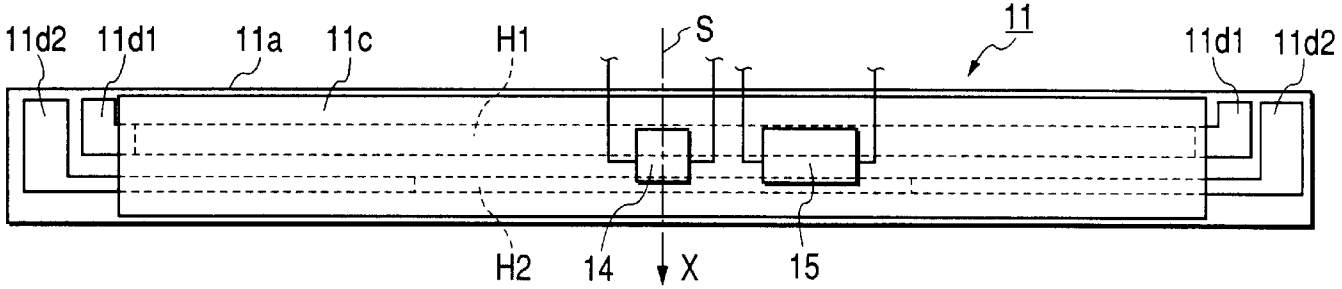
Figure 12C:
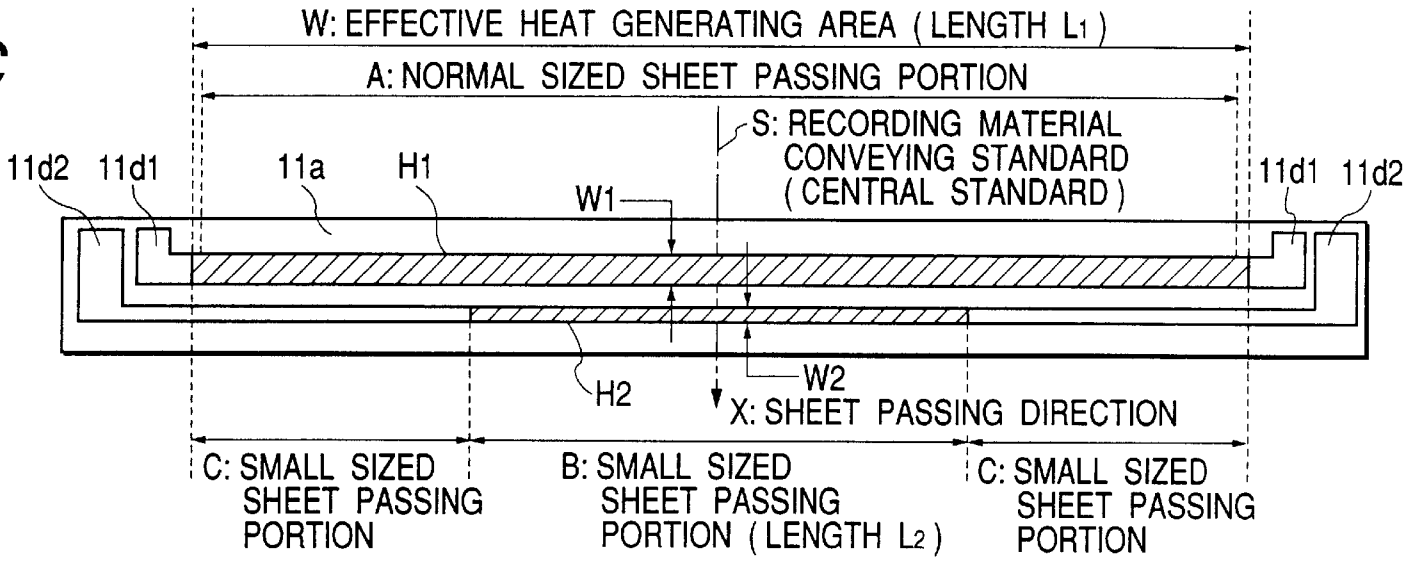

The heater 11 is a zone heating and rear surface heating type of ceramic heater which has a constitution similar to the above-described constitution of FIG. 11.

The normal sized sheet heating member H1 for A4, LTR, and the like as a first size recording material is disposed on the upstream side of the sheet passing direction, and the small sized sheet heating member H2 for envelopes, and the like as a second size recording material is disposed on the downstream side of the sheet passing direction. The length (sheet passing width) L1 of the normal sized sheet heating member H1 and the length L2 of the small sized sheet heating member H2 are 222 mm and 116 mm as described above. The normal sized sheet is also a maximum size sheet. The heating members H1 and H2 are disposed on the substrate along the longitudinal direction of the substrate 11*a*.

The resistance value R1 of the normal sized sheet heating member H1 is set to 13.4Ω, so that even when input voltage fluctuates, power shortage is not caused, excellent fixing properties are obtained, and electric noise levels such as flicker and high harmonic wave distortion are suppressed.

The resistance value R2 of the small sized sheet heating member H2 is lowered because of a narrow sheet passing width, but is set to the same value as that of the normal sized sheet heating member H1 by narrowing the heating member width W2 because there are restrictions of electric noises such as flicker and high harmonic wave distortion.

Therefore, the width W1 of the normal sized sheet heating member H1 is 3 mm, the resistance value R1 is 13.4Ω (about 746 W during 100 V input), and the width W2 of the small sized sheet heating member H2 is 1.57 mm.

Additionally, in the embodiment, to simplify the process of manufacturing the heater, the adjustment of the resistance value of the small sized sheet heating member H2 is performed by changing the width, but can be performed also by changing the heating member material or thickness.

Figure 13:
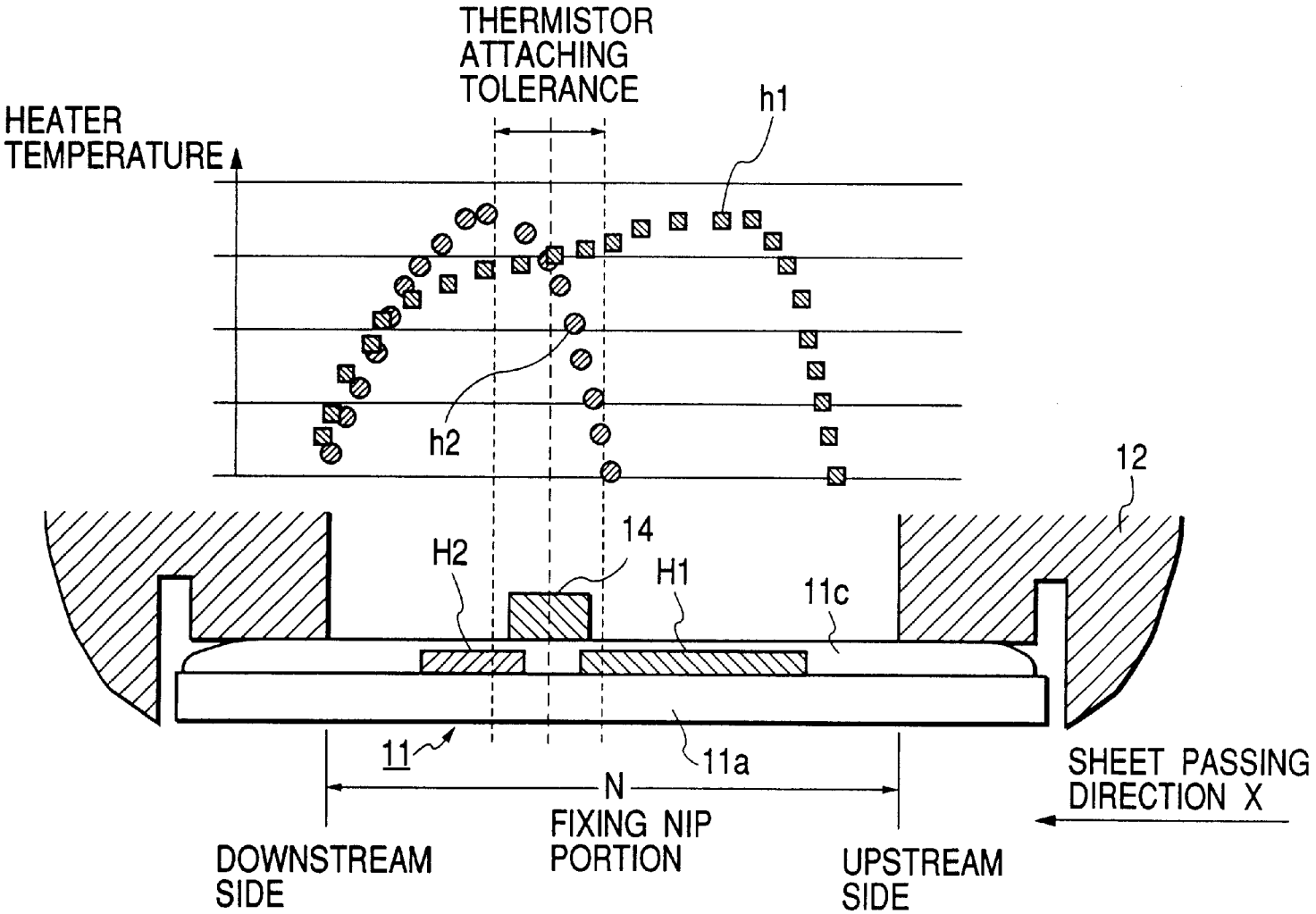
FIG. 13 is a diagram showing the temperature distribution of the width direction of a fixing nip portion when the heating members H1 and H2 are independently energized.

As described above, for the zone heating type heater having a plurality of heating members H1 and H2, when the heating members H1 and H2 are independently energized, the temperature distributions during sheet passing are obtained as described above and shown by h1 and h2 of FIG. 13. Specifically, when only the heating member H1 is turned on, the temperature in the heater substrate is substantially uniformed. When only the heating member H2 is turned on, however, a large temperature gradient is generated in the heater substrate. This is because the heat flux to the sheet from the heater during the sheet passing through the fixing nip portion N differs on the upstream side and the downstream side of the sheet passing direction. Specifically, while the sheet is passed through the fixing nip portion, temperature rises, the heat flux to the sheet from the heater increases on the upstream side on which sheet temperature is low, and the heat flux decreases on the downstream side on which the sheet temperature is high. Therefore, when the heating member H2 is disposed on the downstream side, the temperature gradient increases particularly in the upstream and downstream directions of the fixing nip portion.

In the embodiment, for normal sized sheets, only the heating member H1 is energized, and the heating member H2 is not energized. The embodiment for small sized sheets will be described hereinafter.

Figure 4:
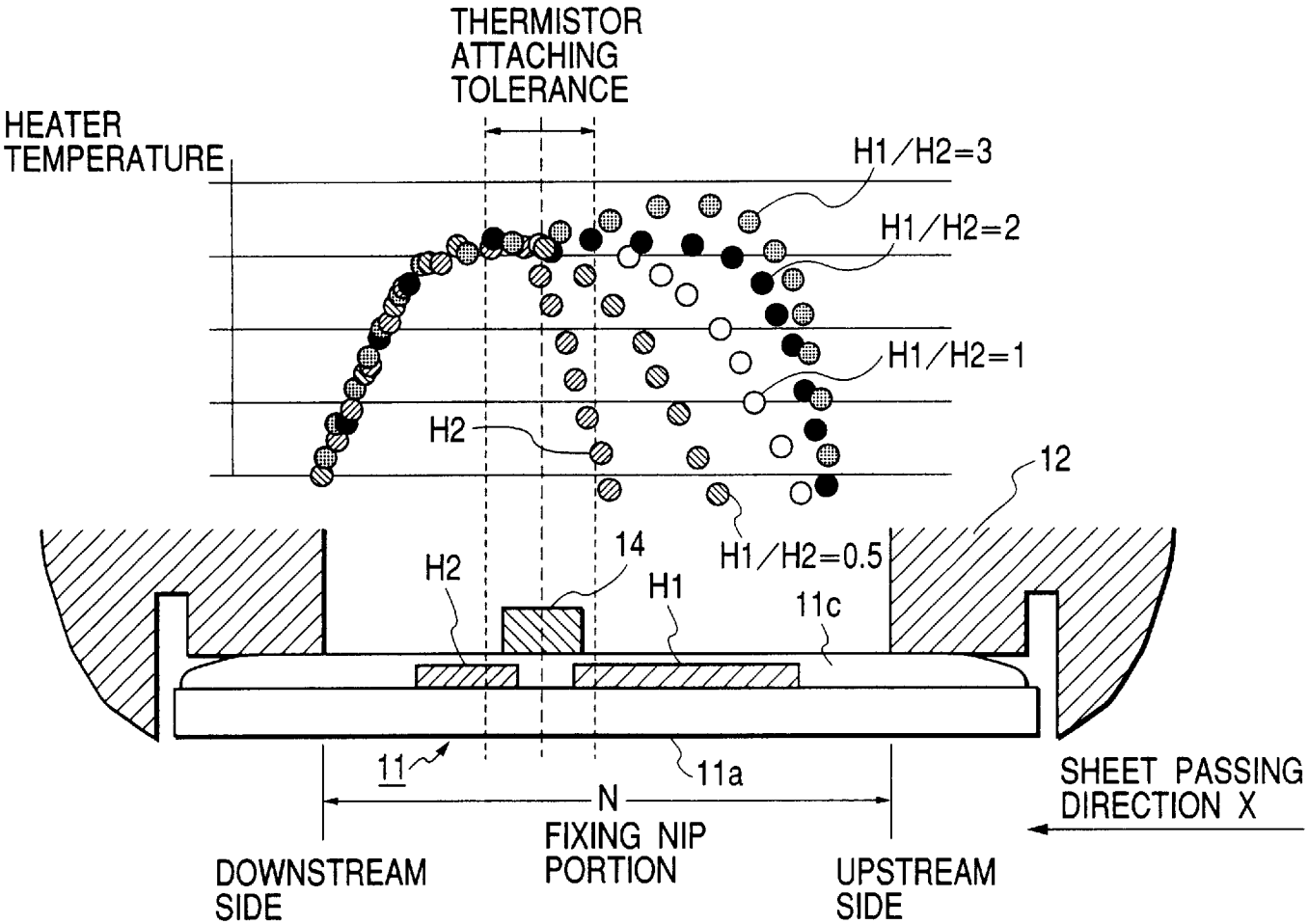
FIG. 4 is a diagram showing temperature distributions in a width direction of a fixing nip portion when heating members H1 and H2 are both energized.

FIG. 4 shows the temperature distributions when sheets are passed by changing the energizing duties of the normal sized sheet heating member H1 and the small sized sheet heating member H2 according to the present invention. The power ratio per unit longitudinal length of each heating member H1 or H2 is shown in Table 1, and the energizing duty and the power ratio per unit longitudinal length of the heating member H1 or H2 are shown in Table 2.

TABLE 1

| Power per Unit Longitudinal Length of each Heating Member | | | |
|---|---|---|---|
| Heating Member | Power P (= $V^2/R$) | Length L | Power P/W per Unit Length |
| H1 for normal sized sheets | 746 W | 222 mm | 3.36 W/mm |
| H2 for small sized sheets | 746 W | 116 mm | 6.43 W/mm |

TABLE 2

| Heating Mernber Lighting Duty and Power per Unit Longitudinal Length | |
|---|---|
| Lighting Duty (H1/H2) | Power Ratio per Unit Length (H1/H2) |
| 1/2 | 0.26 |
| 1/1 | 0.52 |
| 2/1 | 1.05 |
| 3/1 | 1.57 |

*The power ratio when the heating member having power P1 or P2 per unit longitudinal length is lit with a lighting duty a:b in calculated by P1 × a/(a + b):P2 × b/(a + b).

As seen from FIG. 4, when the small sized sheet heating member H2 and the normal sized sheet heating member H1 are simultaneously energized, the temperature on the upstream side of the fixing nip portion N rises. Furthermore, when the power ratios per unit lengths of the heating members H1 and H2 are brought close to each other, the temperature in the heater substrate is more uniformed.

Table 3 shows small sized sheet fixing properties and detected temperature errors generated by the attaching tolerance of the thermistor 14 as the temperature detecting member when only the small sized sheet heating member H2 is energized and when the energizing is performed with the duties shown in the above Table 2.

TABLE 3

| Energizing Duty, Fixing Properties, Detected Temperature Error | | |
|---|---|---|
| Energizing Duty (H1/H2) | Fixing Property | Detected Temperature Error |
| Only H2 for small sized sheets | Bad | 20 deg |
| 1/2 | Good | 10 deg |
| 1/1 | Good | 10 deg |
| 2/1 | Good | 6 deg |
| 3/1 | Good | 6 deg |

Fixing property; good, slightly bad, bad
Temperature-controlled temperature: 190° C.

It is seen from Table 3 that when the normal sized sheet heating member H1 is also energized during the passing of small sized sheets, the fixing property of the small sized sheet can be enhanced, and the temperature dispersion within the attaching tolerance of the thermistor 14 can also be reduced.

From this result, the power ratio per unit length is preferably set to H1/H2≧about 0.5, so that an excellent small sized sheet fixing property can be obtained and the detected temperature error of the thermistor is suppressed down to about 10 deg.

As described above, in the embodiment, for the small sized sheet, the heating member H1 is also energized together with the heating member H2. At this time, since the heating member H2 is also energized, the energizing amount to the heating member H1 becomes smaller than the energizing amount to the heating member H1 for obtaining the predetermined fixing temperature only with the heating member H1. Therefore, the temperature rise of the sheet not-passing portion can be suppressed as compared with when the small sized sheet is fixed only with the heating member H1.

Figures 5A, 5B:
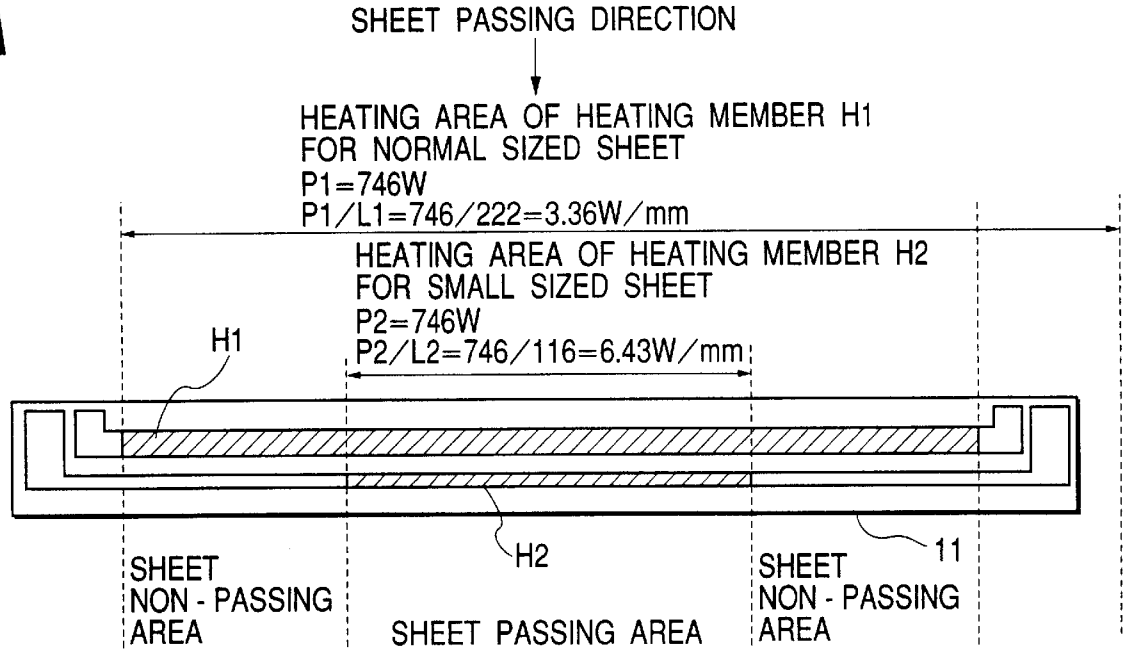
FIGS. 5A and 5B are diagrams showing the relations of power ratios between the heating members H1 and H2 and between a sheet passing portion and a sheet non-passing portion.

However, as shown in FIGS. 5A, 5B, by changing the energizing duty of the normal sized sheet heating member H1 and the small sized sheet heating member H2, the power ratio per unit length also changes, and similarly the power ratio of the sheet passing portion and the sheet non-passing portion also changes. Therefore, if the power of H1 is excessively large, the temperature rise of the sheet non-passing portion is also influenced. Table 4 shows the relation between the power ratio of the sheet passing portion and the sheet non-passing portion with each energizing duty of Table 2 and the temperature rise of the sheet non-passing portion. Additionally, the end portion temperature rise indicates the temperature when 75 com envelopes are continuously passed with a throughput of 16 ppm.

TABLE 4

| Energizing Duty and Sheet Non-Passing Portion Temperature Rise | | | |
|---|---|---|---|
| Energizing Duty (H1/H2) | Power Ratio per Unit Length (H1/H2) | Power Ratio per Unit Length (Sheet Passing/Non-Passing Portion) | End Portion Temperature Rise |
| Only H2 | — | — | 100° C. |
| 1/2 | 0.26 | 4.85 | 160° C. |
| 1/1 | 0.52 | 2.92 | 230° C. |

TABLE 4-continued

| Energizing Duty and Sheet Non-Passing Portion Temperature Rise | | | |
|---|---|---|---|
| Energizing Duty (H1/H2) | Power Ratio per Unit Length (H1/H2) | Power Ratio per Unit Length (Sheet Passing/Non-Passing Portion) | End Portion Temperature Rise |
| 2/1 | 1.05 | 1.95 | 270° C. |
| 3/1 | 1.57 | 1.64 | 270° C. or more |

*In the power ratio per unit length of H1:H2 = P1:P2, the power ratio of the sheet passing portion and the sheet non-passing portion is calculated by the sheet passing portion: the sheet noon-passing portion = P1:P1 + P2 (see FIG. 5).
*The heat resistant temperature of the heater holder is 300 ° C. In this case, a margin of 10% is provided, and the design target value is set to 270° C. or less.

As seen from Table 4, to pass the envelope with a full throughput (16 ppm), the power ratio needs to be the sheet passing portion/the sheet non-passing portion≧about 1.95, but the sheet passing portion/the sheet non-passing portion≧about 1.4 is a level having no practical problem (the throughput reduction of about ⅔ of the normal sized sheet throughput is allowed).

Moreover, in the embodiment, the rear surface heating type heater 11 is used, but even when the conventional type (surface heating type provided with the heating layer on the pressurizing roller side of the substrate) of heater using the AlN substrate is used, the similar effect can be obtained.

As described above, in the-embodiment, since during the small sized sheet passing the normal sized sheet heating member H1 and the small sized sheet heating member H2 are lit with the power ratio of about 0.5≦H1/H2≦2.5, the small sized sheet fixing property can be enhanced, and the temperature detection error by the attaching position deviation of the thermistor 14 can be reduced.

<Second Embodiment> (FIGS. 6, 7)

In the embodiment, the speed of the apparatus is increased to 24 ppm for A4 vertical, and the process speed of 151 mm/s. With the speedup, the power consumption during the normal sized sheet passing needs to be increased to 880 W from 746 W of the first embodiment, thereby causing a problem of an increase in flicker and high harmonic distortion.

Figure 6A:
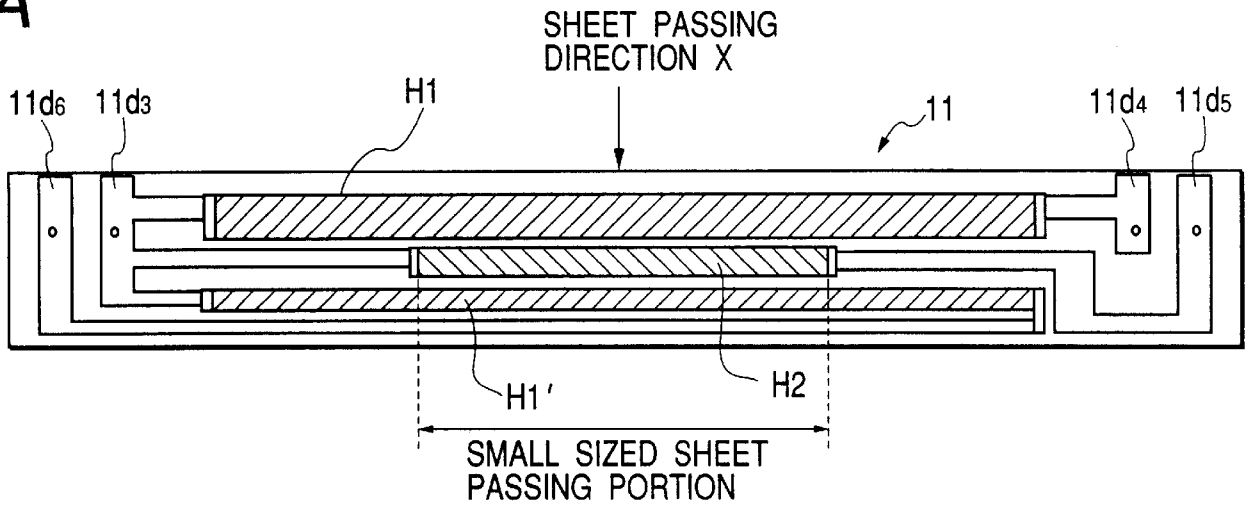
FIGS. 6A and 6B are diagrams showing the constitutions of heating members in other embodiments.
Figure 6B:
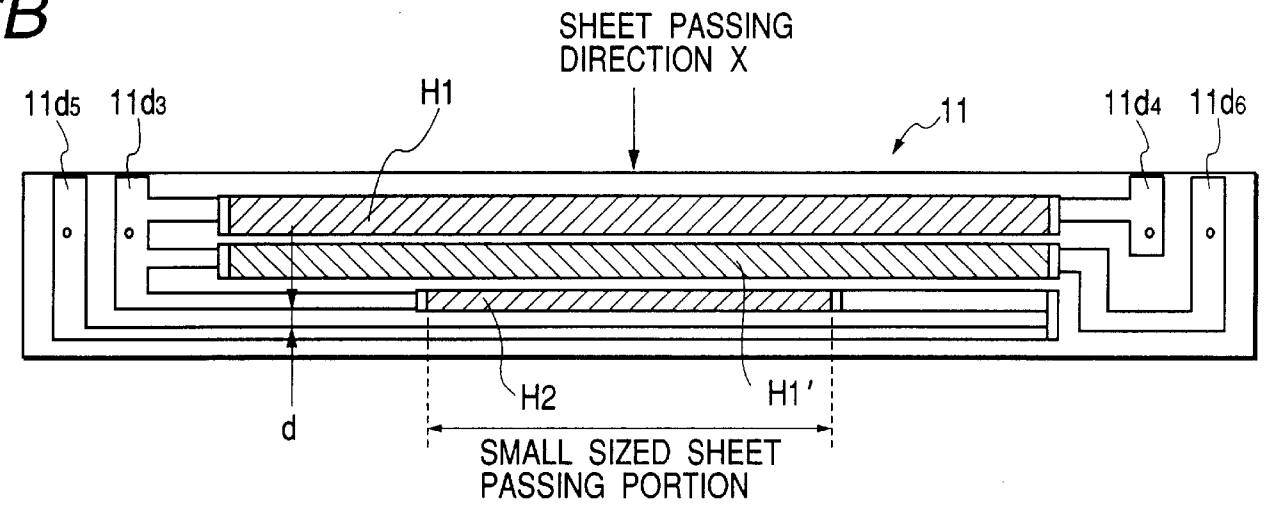

To solve the problem, as shown in FIGS. 6A and 6B, the normal sized sheet heating member is divided into two members H1 and H1'. By allowing ON timing to deviate and independently driving the members, the electric noises such as flickers are reduced. In the constitution, the heating member H1' is disposed along the longitudinal direction of the substrate on the substrate in the same manner as the heating members H1 and H2. An electrode 11*d*3 is common to the heating members H1, H2, H1', an electrode 10*d*4 is disposed for the heating member H1, an electrode 11*d*5 is for the heating member H2, and an electrode 11*d*6 is for the heating member H1'.

As a method of arranging the normal sized sheet heating members H1 and H1', there are two methods of arranging the normal sized sheet heating member H1, the small sized sheet heating member H2, and the normal sized sheet heating member H1' from the upstream side to the downstream side of the sheet passing direction as shown in FIG. 6A, and arranging the normal sized sheet heating member H1, the normal sized sheet heating member H1', and the small sized sheet heating member H2 as shown in FIG. 6B. Either method can provide the similar effect. In the arrangement of FIG. 6B, however, the distance d between wiring patterns needs to be longer than the distance between the wiring and the heating member or between the heating members (since there is no voltage drop by the heating member, a large potential difference is applied to the wiring pattern), the heater substrate width is enlarged, and the cost tends to increase.

Moreover, as shown in FIG. 6A, when the small sized sheet heating member H2 is disposed between the heating members H1 and H1', during the fixing of the small sized sheet, the mainly heated heating member H2 can be disposed in the middle of the width direction of the substrate, which is advantageous for heating the entire substrate.

In the embodiment, the arrangement example of FIG. 6A will be described. Additionally, the other conditions are similar to those of the above-described first embodiment, and the description thereof is omitted.

Even in this constitution, when only the small sized sheet heating member H2 is energized, the problems similar to those described above are generated.

To solve the problem, in the embodiment, the heating members H1 and H1' are energized during the normal sized sheet passing, and the heating members H1 and H2 are energized during the small sized sheet passing. In this case, as described in the first embodiment, the heat flux to the sheet differs on the upstream side and the downstream side of the fixing nip portion N. Therefore, when the heating members H1 and H1' are lit with the same power ratio, the temperature in the heater substrate is not uniformed.

Table 5 shows the detected temperature error generated by the attaching tolerance of the thermistor 14 when the heating members H1 and H1' are energized with the changed power ratio.

TABLE 5

Power Ratio of Heating Members H1, H1' and Thermistor Detected Temperature Error

| Power Ratio H1/H1' | Thermistor Detected Temperature Error |
|---|---|
| 1 | 15 deg |
| 1.5 | 10 deg |
| 2 | 8 deg |
| 3 | 8 deg |

As seen from Table 5, when the power ratio H1/H1' is about 1.5 or more, the temperature in the fixing nip portion becomes substantially uniform, and the detection error by the position deviation of the thermistor 14 can be set to about 10° C.

Moreover, during the small sized sheet passing, when the heating members H1 and H2 are controlled with the energizing duty H1:H2=2:1 (for the power ratio per unit length, H1/H2=0.65, the sheet passing portion: the sheet non-passing portion=2.5:1), the excellent small sized sheet fixing property can be obtained in the same manner as in the above-described first embodiment, and the detected temperature deviation by the position deviation of the thermistor 14 can be reduced.

Figure 7A:
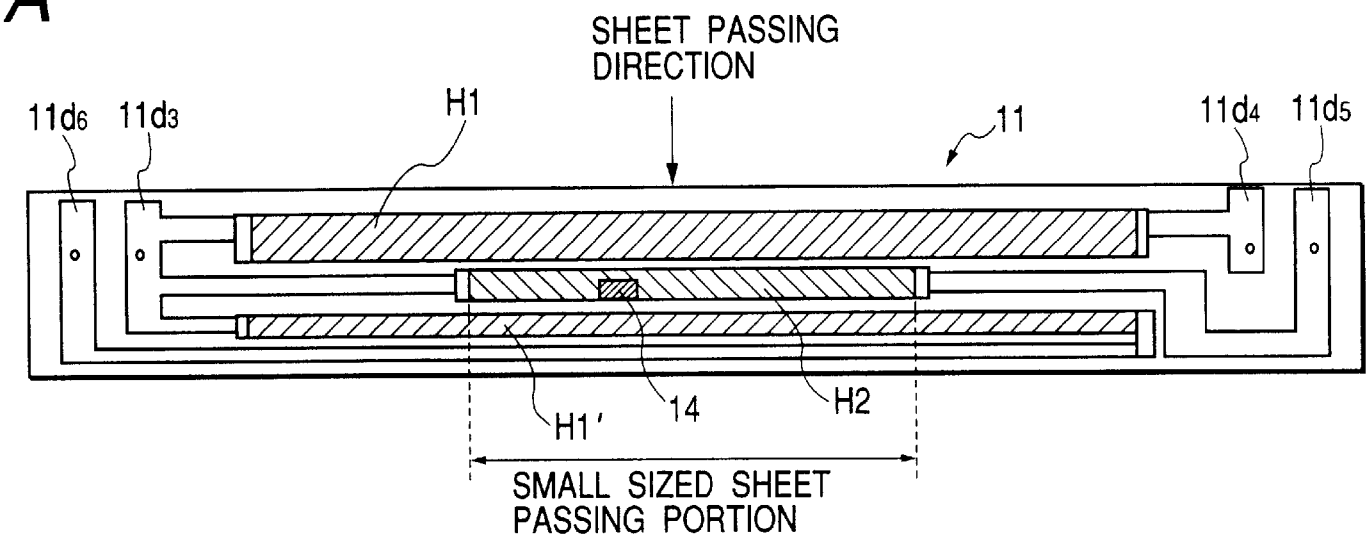
FIGS. 7A and 7B are diagrams showing the constitution of a heater in which a thermistor is disposed.
Figure 7B:
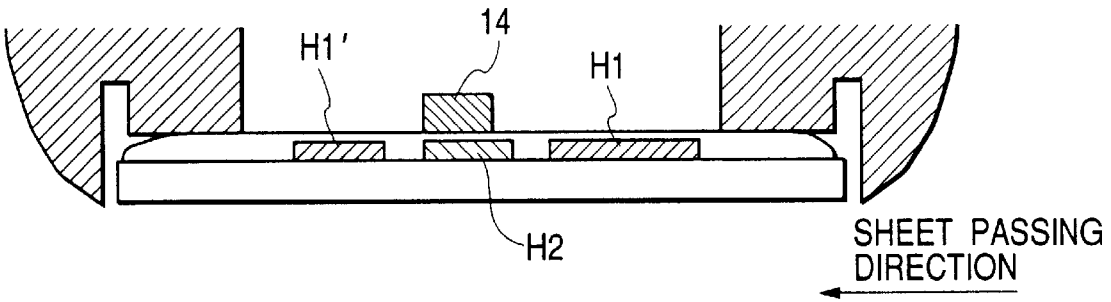

Additionally, the arrangement position of the thermistor 14 may be determined in consideration of a portion where the temperature distribution of the heater width direction generated when the heating members H1 and H1' are energized is flatted, and a portion where the temperature distribution of the heater width direction generated when the heating members H1 and H2 are energized is flatted. In the embodiment of FIG. 6A, the thermistor 14 is disposed on the downstream side of the sheet passing direction slightly from the center of the-heating member H2 as shown in FIG. 7. Additionally, FIG. 7A is a front view as seen from the underside of the heater, and FIG. 7B is a side view.

As described above, even when the power consumption is increased by the increase of the print speed in the constitution, the detection error by the position deviation of the temperature detecting element 14 for temperature control can be reduced without increasing the electric noises such as flickers and high harmonic distortion, and the small sized sheet fixing property can be enhanced.

Figure 8:
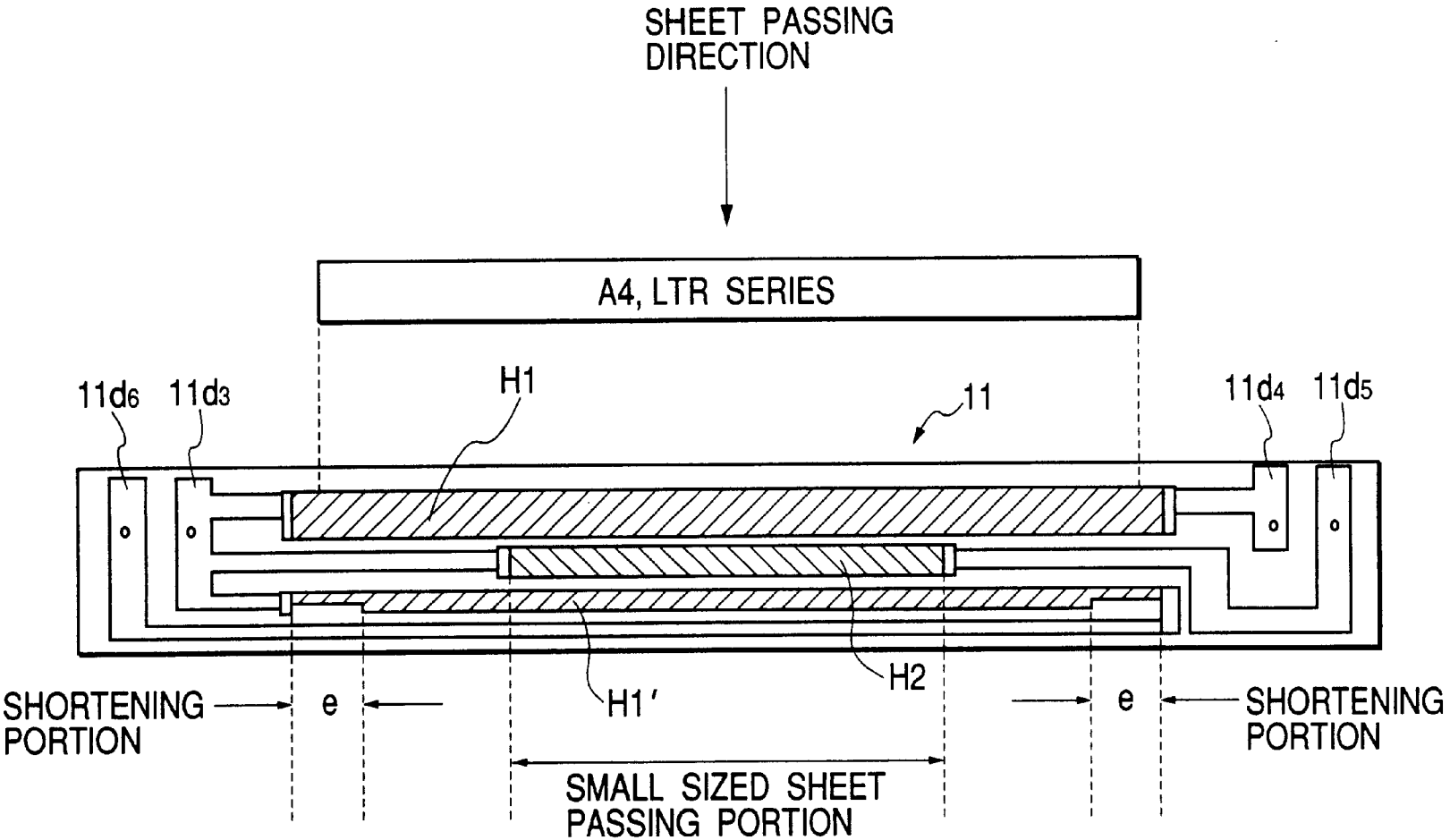
FIG. 8 is a diagram showing the constitution of the heating member in another embodiment.
Figure 9:
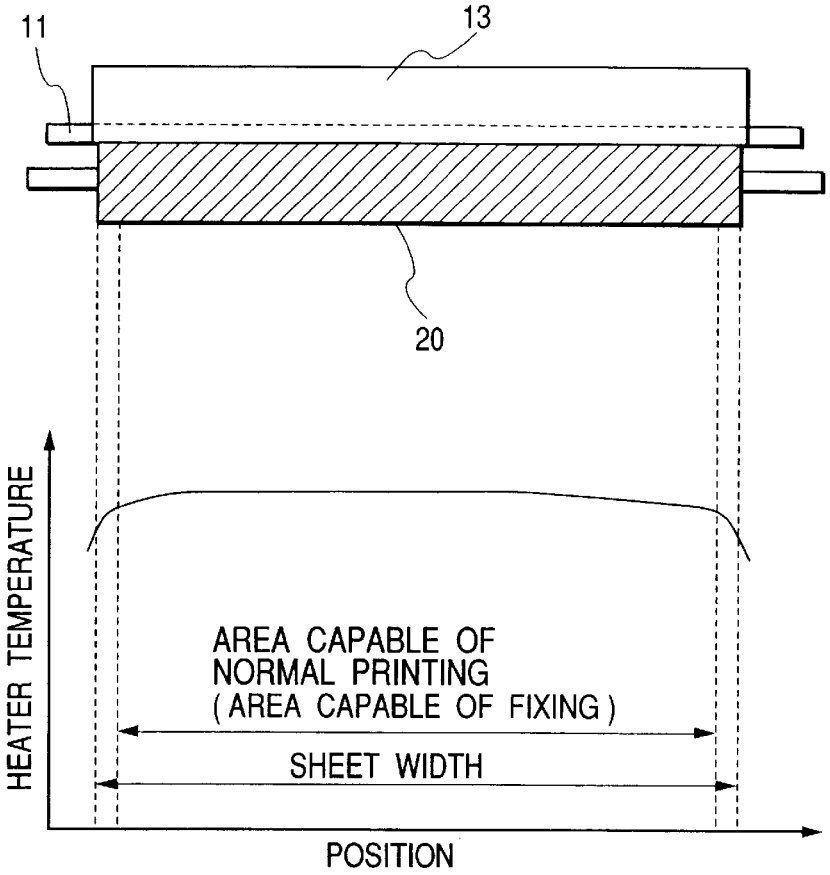
FIG. 9 is a diagram showing an end portion temperature sag.
Figure 10:
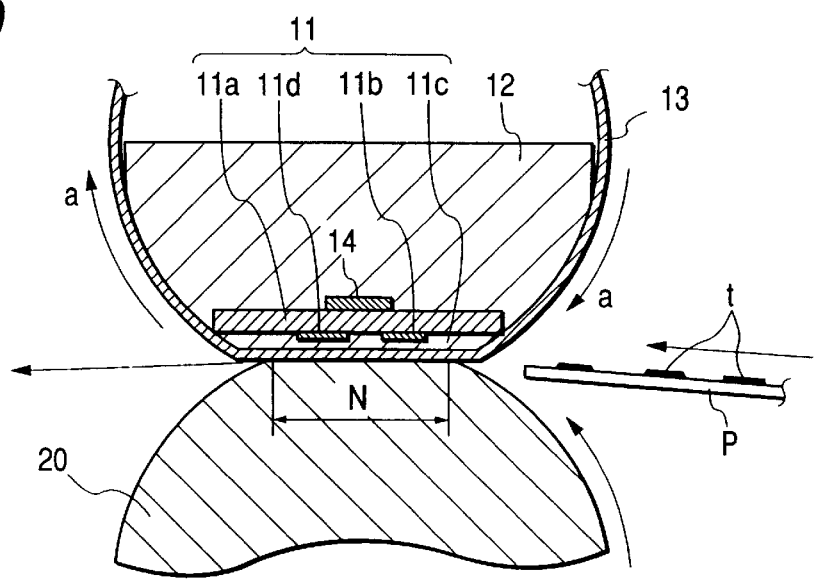
FIG. 10 is a diagrammatic view showing a main part of one example of an image heating apparatus (heating/fixing apparatus) of a film heating system.

<Third Embodiment> (FIGS. 8, 9)

The third embodiment is constituted by providing both end portions of the heating member H1' not energized during the small sized sheet passing with shortening portions e, e as shown in FIG. 8 in the heater of the above-described second embodiment, so that the heat generating amount of both end portions of the heating member H1' is increased. Additionally, the other conditions are similar to those of the above-described second embodiment, and the description thereof is omitted.

The area capable of printing (area capable of fixing) is usually 5 mm inside each sheet end. In recent years, however, there has been a demand for printing in the vicinity of the endmost portion of the sheet. To satisfy the demand, the width of the fixing apparatus is preferably enlarged in consideration of temperature sag by heat radiation of the end portions of the fixing apparatus as shown in FIG. 9. However, this results in an enlarged size of the printer.

Therefore, the third embodiment is constituted so that the heat generating amount of the heating member is increased at each end portion of the heating member H1' not energized during the small sized sheet passing so as to enhance the fixing property of the sheet endmost portion without enlarging the width of the fixing apparatus. Thereby, the fixing up to the sheet endmost portion can be realized without deteriorating the temperature rise of the sheet non-passing portion during the small sized sheet passing.

Table 6 shows the relation between the increase of the heat generating amount of the end portion of the heating member H1' and the fixing property of the sheet endmost portion. Additionally, the heat generating amount is controlled by changing the widths of the center and end portions of the heating member to change the resistance value, but may be controlled by changing the material and thickness of the heating member.

TABLE 6

Heat Generating Amount UP of Heating Member H1' and End Portion Fixing Property

| Shortening Amount of Heating Member Hl' | Fixing Property 5 mm outside End Portion |
|---|---|
| 0% | Slightly bad |
| 4% | Slightly bad |
| 8% | Good |
| 12% | Good |

Fixing Property; Good, slightly bad, bad

As seen from Table 6, by increasing the heat generating amount of the end portion of the heating member H1' by about 8%, the fixing to the entire sheet surface can be realized. Moreover, for the small sized sheet fixing property and the thermistor detection temperature error, the effect similar to that of the above-described second embodiment can be obtained.

As described above, by increasing the heat generating amount of the end portion of the heating member H1' which is not lit at the same time as the small sized sheet heating member H2, among the normal sized sheet heating members H1, H1', the excellent end portion fixing property can be obtained. Additionally, the excellent small sized sheet fixing property can be obtained and the thermistor detection temperature deviation can be reduced.

Additionally, the image heating apparatus of the present invention is not limited to the heater 11 of the rear surface heating type in the embodiment, and may be of the surface heating type.

Moreover, the sheet passing standard of the recording material P may of course be a one-side standard.

Furthermore, the image heating apparatus of the present invention is not limited to the fixing apparatus of each embodiment, and can be used as means and apparatuses for extensively heating/processing the material to be heated, such as an apparatus for heating the image bearing recording material to enhance surface properties such as gloss, an image heating apparatus for a tentative fixing apparatus, an apparatus for heating/drying the material to be heated, and a heating laminate apparatus.

Additionally, the principle and process for forming the unfixed toner image t on the recording material P are not limited, and are arbitrary.

The embodiments of the present invention have been described above, but the present invention is not limited to the above-described embodiments, and can variously be modified within the technical scope of the present invention.

What is claimed is:

1. An image heating apparatus comprising:

a heater including a long base material;

a temperature detecting element for detecting temperature of said heater; and a film having a first surface which slides on said heater and a second surface which moves while contacting a recording material bearing an image, wherein (a) said heater is controlled by an output from said temperature detecting element to obtain a predetermined temperature and the image on the recording material is heated by heat from said heater via said film, (b) said heater further comprises a first heating member and a second heating member shorter than said first heating member which are disposed along a longitudinal direction of said base material and generate heat by being energized (c) said first heating member is disposed on an upstream side of said second heating member with respect to a moving direction of the recording material, (d) when a first size recording material is heated, said first heating member is energized and said second heating member is not energized, and (e) when a second size recording material smaller than said first size recording material is heated, said first heating member and said second heating member are energized.

2. An image heating apparatus according to claim 1, wherein said temperature detecting element contacts said heater.

3. An image heating apparatus according to claim 2, wherein said heater includes a protective layer for covering said first heating member and said second heating member, and said temperature detecting element is disposed on said protective layer.

4. An image heating apparatus according to claim 1, wherein a resistance value per unit length of said second heating member is larger than that of said first heating member.

5. An image heating apparatus according to claim 4, wherein a width of said second heating member along the moving direction of the recording material is smaller than that of said first heating member.

6. An image heating apparatus according to claim 1, wherein said heater further comprises a third heating member which is disposed along the longitudinal direction of said base material and generates heat by being energized, a length of said third heating member is substantially the same as that of said first heating member, and said third heating member is energized together with said first heating member when the first size recording material is heated.

7. An image heating apparatus according to claim 6, wherein said third heating-member is disposed on a downstream side of said second heating member with respect to the moving direction of the recording material.

8. An image heating apparatus according to claim 6, wherein said third heating member is disposed on a downstream side of said first heating member and on the upstream side of said second heating member with respect to the moving direction of the recording material.

9. An image heating apparatus according to claim 6, wherein an end portion of said third heating member in the longitudinal direction thereof has a resistance value per unit length larger than that of a central portion.

10. An image heating apparatus according to claim 9, wherein a width along the moving direction of the recording material of the end portion of said third heating member in the longitudinal direction thereof is smaller than that of the central portion.

11. An image heating apparatus according to claim 1, wherein said film contacts a surface of said base material opposite to a surface on which said first heating member and said second heating member are disposed.

12. An image heating apparatus according to claim 1, further comprising a roller for forming a nip with said heater via said film, the recording material bearing an unfixed image at said nip being nipped and conveyed, and the unfixed image being fixed on the recording material by the heat from said heater via said film.

13. A heater for heating an image, said-heater comprising:

a long base material;

a temperature detecting element for detecting temperature; and a first heating member and a second heating member shorter than said first heating member which are disposed along a longitudinal direction of said base material and generate heat by being energized, wherein (a) said first heating member and said second heating member are arranged in a direction orthogonal to the longitudinal direction of said base material, heat generating areas of said first heating member and said second heating member in a longitudinal direction of said base material are overlapping, (b) said first heating member is disposed for heating a first size recording material and a second size recording material smaller than the first size recording material, and (c) said second heating member is disposed for heating the second size recording material.

14. A heater according to claim 13, further comprising a protective layer for covering said first heating member and said second heating member, said temperature detecting element being disposed on said protective layer.

15. A heater according to claim 13, wherein a resistance value per unit length of said second heating member is larger than that of said first heating member.

16. A heater according to claim 15, wherein a width of said second heating member along the direction orthogonal to the longitudinal direction of said base material is smaller than that of said first heating member.

17. A heater according to claim 13, further comprising a third heating member which is disposed along the longitudinal direction of said base material and generates heat by being energized, a length of said third heating member being substantially the same as that of said first heating member, said third heating member, said first heating member and said second heating member being arranged in the direction orthogonal to the longitudinal direction of said base material, and said third heating member being disposed for heating the first size recording material.

18. A heater according to claim 17, wherein said third heating member is disposed on an opposite side to said first heating member with respect to said second heating member as a center.

19. A heater according to claim 17, wherein said third heating member is disposed between said first heating member and said second heating member.

20. A heater according to claim 17, wherein an end portion of said third heating member in the longitudinal direction thereof has a resistance value per unit length larger than that of a central portion.

21. A heater according to claim 20, wherein a width along the direction orthogonal to the longitudinal direction of said base material of the end portion of said third heating member in the longitudinal direction thereof is smaller than that of the central portion.

22. A heater for heating an image, said heater comprising:

a long base material;

a first heating member;

a second heating member, said second heating member being shorter than said first heating member; and a third heating member, said third heating member having substantially a same length as a length of said first heating member, wherein (a) said first heating member, said second heating member, and said third heating member are each disposed along a longitudinal direction of said base material and generate heat by being energized, (b) said first heating member, said second heating member and said third heating member are arranged in a direction orthogonal to the longitudinal direction of said base material, heat generating areas of said first heating member, said second heating member and said third heating member in a longitudinal direction of said base material are overlapping, and (c) said second heating member is disposed between said first heating member and said third heating member with respect to the direction orthogonal to the longitudinal direction of said base material.

23. A heater according to claim 22, wherein said first heating member is disposed for heating a first size recording material and a second size recording material smaller than the first size recording material, said second heating member is disposed for heating the second size recording material, and said third heating member is disposed for heating the first size recording material.

24. A heater according to claim 22, further comprising temperature detecting element for detecting temperature and a protective layer for covering said first heating member, said second heating member and said third heating member, said temperature detecting element being disposed on said protective layer.

25. A heater according to claim 22, wherein a resistance value per unit length of said second heating member is larger than that of said first heating member.

26. A heater according to claim 25, wherein a width of said second heating member along the direction orthogonal to the longitudinal direction of said base material is smaller than that of said first heating member.

27. A heater according to claim 22, wherein an end portion of said third heating member in the longitudinal direction thereof has a resistance value per unit length larger than that of a central portion.

28. A heater according to claim 27, wherein the width along the direction orthogonal to the longitudinal direction of said base material of the end portion of said third heating member in the longitudinal direction thereof is smaller than that of the central portion.

29. An image heating apparatus according to claim 1, wherein, with respect to the moving direction of the recording material, said temperature detecting element is provided on a downstream side of an end portion on an upstream side of said first heating member.

30. An image heating apparatus according to claim 29, wherein, with respect to the moving direction of the recording material, said temperature detecting element is provided on an upstream side of an end portion on a downstream side of said second heating member.

31. An image heating apparatus according to claim 7, wherein, with respect to the moving direction of the recording material, said temperature detecting element is provided on a downstream side of an end portion on an upstream side of said first heating member and on an upstream side of an end portion on a downstream side of said third heating member.

* * * * *

UNITED STATES PATENT AND TRADEMARK OFFICE

CERTIFICATE OF CORRECTION

PATENT NO. : 6,336,009 B1
DATED : January 1, 2002
INVENTOR(S) : Masahiko Suzumi et al.

It is certified that error appears in the above-identified patent and that said Letters Patent is hereby corrected as shown below:

Column 6,
Line 32, "uniformly." should read -- uniform. --.

Column 7,
Line 6, "contacts" should read -- contacting --.

Column 10,
Line 18, "of-a" should read -- of a --.

Column 13,
Line 53, "com" should read -- com 10 --.

Column 14,
Line 14, "noon-passing" should read -- non-passing --.

Column 18,
Line 11, "heating-member" should read -- heating member --.
Line 37, "said-heater" should read -- said heater --.

Signed and Sealed this

Twenty-first Day of May, 2002

*Attest:*

*Attesting Officer*

JAMES E. ROGAN
*Director of the United States Patent and Trademark Office*